US005096316A

United States Patent [19]

Otsuka et al.

[11] Patent Number: 5,096,316

[45] Date of Patent: Mar. 17, 1992

[54] SERIAL PRINTER

[75] Inventors: Fumio Otsuka; Mikio Hayashi, both of Tokyo, Japan

[73] Assignee: Seikosha Co., Ltd., Tokyo, Japan

[21] Appl. No.: 436,287

[22] Filed: Nov. 14, 1989

[30] Foreign Application Priority Data

Nov. 18, 1988 [JP] Japan ..... 63-291698

[51] Int. Cl.[5] ..... B41J 29/00

[52] U.S. Cl. ..... 400/692; 400/139; 400/322

[58] Field of Search ..... 400/139, 352, 320, 322, 400/719, 692; 174/36, 69, 102 C, 106 R, 34, 35 R, 35 C; 361/398, 408

[56] References Cited

U.S. PATENT DOCUMENTS

| | | | |
|---|---|---|---|
| 4,397,576 | 8/1983 | Drejza et al. | 400/320 |
| 4,425,047 | 1/1984 | Narushima | 400/320 |
| 4,644,092 | 2/1987 | Gentry | 174/102 C |
| 4,727,805 | 3/1988 | Pichler et al. | 400/320 |
| 4,746,766 | 5/1988 | Soulard | 400/719 |
| 4,750,881 | 6/1988 | Kikuchi et al. | 400/320 |
| 4,902,150 | 2/1990 | Imai et al. | 400/320 |

FOREIGN PATENT DOCUMENTS

| | | | |
|---|---|---|---|
| 206682 | 9/1986 | Japan | 400/692 |

OTHER PUBLICATIONS

IBM Technical Disclosure Bulletin, "Cable Assembly for Disk Drive Head Carriage" Brende, Luoma, and Rigotti, vol. 26, No. 38, 8/1983, pp. 1691-1692.

*Primary Examiner*—Edgar S. Burr
*Assistant Examiner*—Joseph R. Keating
*Attorney, Agent, or Firm*—Jordan and Hamburg

[57] ABSTRACT

A serial printer includes a reciprocably mounted carriage having a printing head, and a generally flat flexible cable extends between the carriage and a drive circuit. A generally flat flexible reinforcing plate comprising a shield electrode is disposed in superimposed relationship to the flexible cable.

25 Claims, 4 Drawing Sheets

SERIAL PRINTER

BACKGROUND OF THE INVENTION

The present invention relates to a serial printer having a printing head which is reciprocated along a guide member.

In conventional serial printers, a flexible cable is connected between a printing head reciprocated along a guide member and a driver circuit in order to supply a driving signal to the printing head.

Since the printing head is reciprocated with one end portion of the flexible cable connected thereto, the bent portion of the flexible cable continuously changes in correspondence with the position of the printing head. However, since the flexible cable is disposed in a narrow gap between a ribbon cassette and a base plate of the printer casing and bent in this narrow gap, the flexible cable may become slack by the sliding load or caught under the carriage of the printing head. In addition, sliding friction occurring between the flexible cable and the ribbon cassette or the base plate causes the surface of the flexible cable to become worn, resulting in the wiring pattern being exposed and further disconnected, thus giving rise to a connection failure. These problems will be particularly critical in the case of an ultra-high speed printer. When an external electromagnetic wave enters the flexible cable, a mal-operation of the printer occurs, and electromagnetic noise generated from the flexible cable has adverse effects on devices placed around the printer.

It is an object of the present invention to prevent the flexible cable from becoming slack, caught or worn, thereby enabling it to endure the reciprocating movement of an ultra-high speed printer, to cut off external electromagnetic waves to thereby eliminate the occurrence of a mal-operation of the printer, and to prevent generation of electromagnetic noise.

SUMMARY OF THE INVENTION

To this end, the serial printer according to the present invention comprises a flexible reinforcing plate disposed at least on the inner side of a flexible cable when the flexible cable is bent, the flexible cable being connected to a printing head reciprocated along a guide member, the reinforcing plate being in opposed contact with the flexible cable and containing a shield electrode which is sufficiently large to cover the flexible cable.

The reinforcing plate has a tongue piece formed on the end portion thereof which is connected to a base plate of the printer, the tongue piece projecting sideward to retain the reinforcing plate in a position where the reinforcing plate is in opposed contact with the flexible cable, and an abutment is formed on a casing of the printer, the abutment engaging with the tongue piece to temporarily retain the end portion of the reinforcing plate when moved out of the position where it is in opposed contact with the flexible cable.

The flexible reinforcing plate functions so as to enhance the elasticity of the flexible cable, thereby preventing the flexible cable from becoming slack, caught or worn. The shield electrode that is contained in the reinforcing plate functions so as to prevent an external electromagnetic wave from entering the flexible cable and also cuts off electromagnetic noise generated from the flexible cable, thereby eliminating the fear of adverse effects on the outside.

BRIEF DESCRIPTION OF THE DRAWINGS

The drawings show in combination one embodiment of the present invention in which.

DESCRIPTION OF THE PREFERRED EMBODIMENTS

Figure 1:
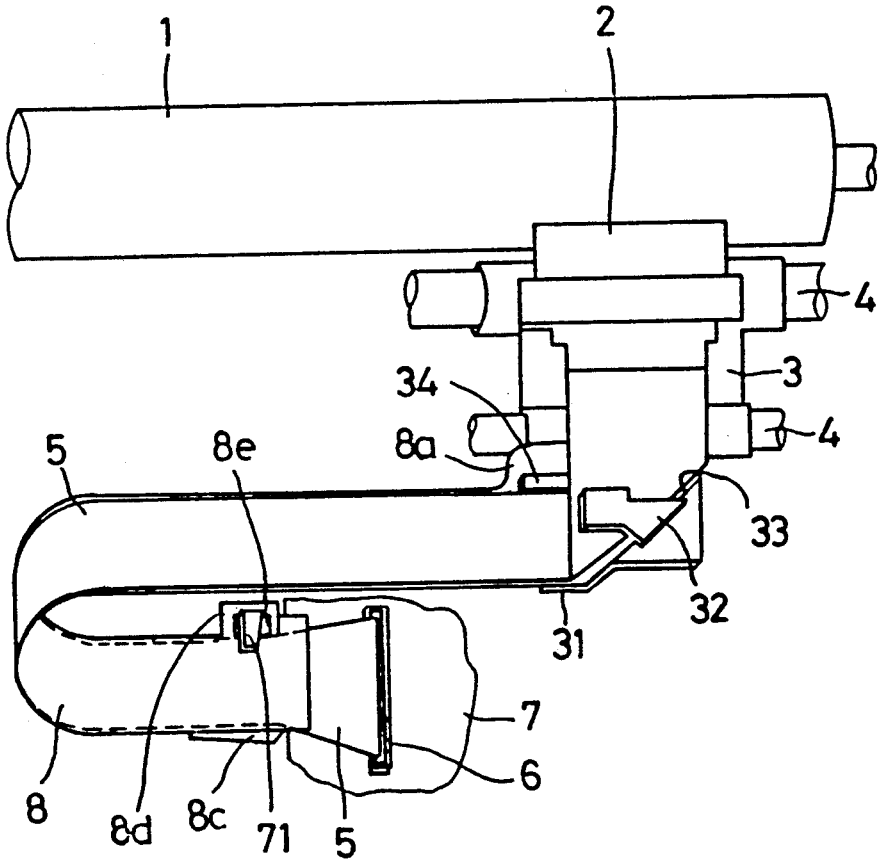
FIG. 1 is a partially cutaway perspective view of the essential parts of one embodiment.
Figure 2:
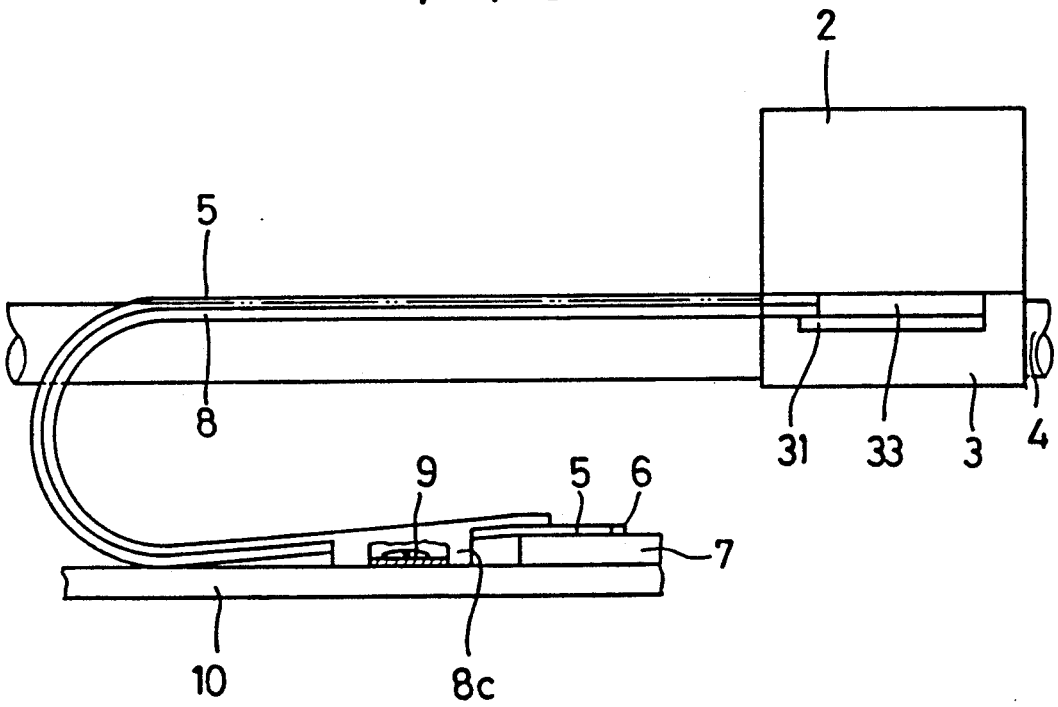
FIG. 2 is an enlarged rear view of such essential parts.

One embodiment of the present invention will be described with reference to the drawings. As shown in FIGS. 1 and 2, a printing head 2 which faces a platen 1 is fixed on a carriage 3 and reciprocated along guide shafts 4 by means of the carriage 3. The printing head 2 has one end portion of a flexible cable 5 connected thereto. The other end portion of the flexible cable 5 is connected to a driver circuit (not shown) through a connector 6. The driver circuit is covered with a cover plate 7 and rigidly secured to a base plate 10 of the printer. The guide shafts 4, the cover plate 7, the base plate 10, and the casing 11 (described hereinafter) constitute a fixed printer structure means in that the carriage moves relative to the fixed printer structure means. The flexible cable 5 provides an electrical connection between the printing head 2 and the driver circuit.

Figure 3:
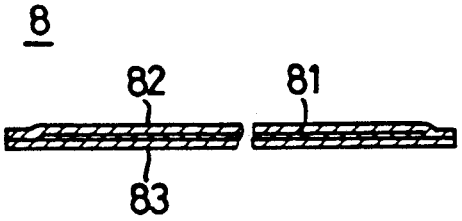
FIG. 3 is a partially cutaway enlarged sectional view of the reinforcing plate.

A reinforcing plate 8 is disposed at least on the inner side of the flexible cable 5 when the flexible cable is bent and the reinforcing plate 8 is in opposed contact with the flexible cable 5. The reinforcing plate 8 comprises three layers as shown in FIG. 3. The center layer is a shield electrode 81 which is constituted by a thin film of an electrically conductive material, for example, copper foil. The shield electrode 81 is sandwiched between two flexible insulating sheets 82 and 83 of polyester or other similar material. The shield electrode 81 is sufficiently large to cover the flexible cable 5.

Figure 4:
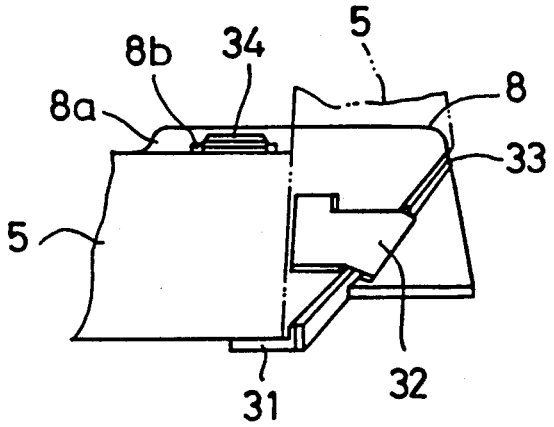
FIG. 4 is an enlarged perspective view showing the way in which the flexible cable and the reinforcing plate are secured at the carriage side.

The following is a description of the means for securing the flexible cable 5 and the reinforcing plate 8 to the carriage 3. As shown in FIGS. 1 and 4, the flexible cable 5 is turned at 90 degrees and clamped, together with one end portion of the reinforcing plate 8, between a receiver 31 which is formed integral with the carriage 3 and a retaining piece 32 which is formed integral with the receiver 31 so as to define a predetermined gap therebetween. The one end portion of the reinforcing plate 8 is provided with a projection piece **8*a* which projects sideward, and an engaging hole 8*b* is provided in the projection piece 8*a*. The receiver 31 has a projection 33 and a hook 34 which are formed integral with it, the projection 33 effecting positioning of the end edge of the reinforcing plate 8 and the fold of the flexible cable 5, and the hook 34 engaging with the engaging hole 8*b*. The hook 34 is adapted to engage with the engaging hole 8b so as to effect positioning and also prevent the reinforcing plate 8** from coming off.

Figure 5:
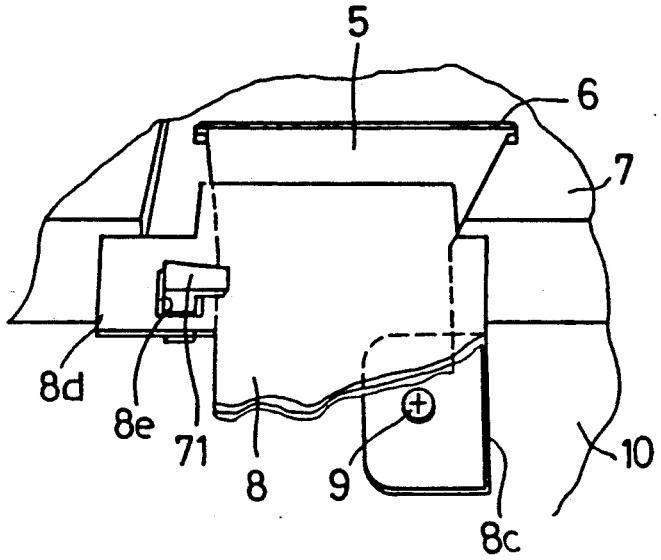
FIG. 5 is an enlarged perspective view showing the way in which the flexible cable and the reinforcing plate are secured at the connector side.
Figure 6:
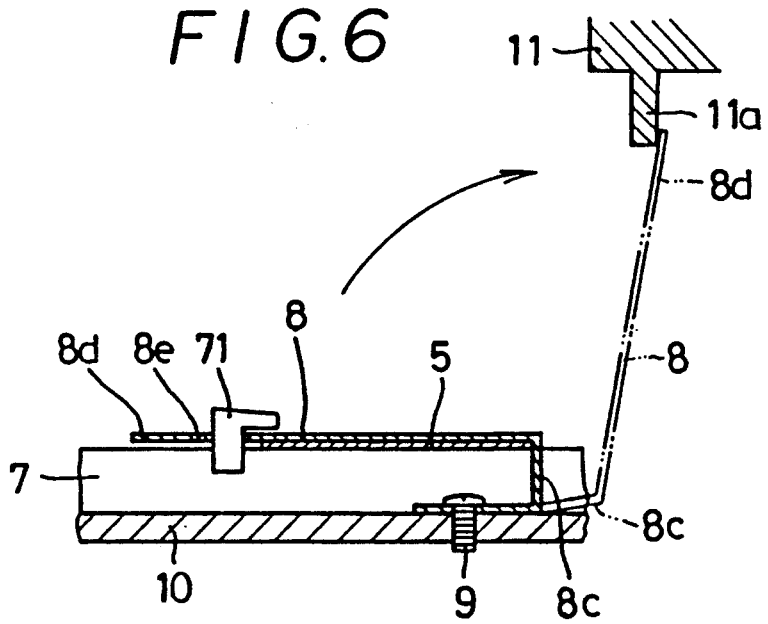
FIG. 6 is an enlarged sectional view showing the condition in which the reinforcing plate is temporarily retained.

The means for securing the reinforcing plate 8 to the base plate 10 of the printer will next be explained. As shown in FIGS. 1, 5 and 6, the other end portion of the reinforcing plate 8 is formed with a ground member 8c projecting sideward. At this ground member, a portion of one sheet 82 is removed so that the shield electrode 81 is exposed, and a part of the shield electrode 81 is plated with solder. The ground member 8c is bent in the form of a U and secured at the above-described solder-plated portion to the base plate 10 by means of a screw 9. It should be noted that, since the base plate 10 is placed at the ground potential, the shield electrode 81 is grounded through the base plate 10. A tongue piece 8d is formed integral with the reinforcing plate 8 so as to project from the side thereof which is opposite the ground member 8c, the tongue piece 8d being provided with an engaging hole 8e. The cover plate 7 has a hook 71 formed integral with it. Thus, by engaging the hook 71 with the engaging hole 8e, the reinforcing plate 8 is retained in a position where it is in opposed contact with the flexible cable 5. Further, as shown in FIG. 6, the casing 11 of the printer, which is also part of the fixed printer structure means as previously described has an abutment 11a extending downward above the ground member 8c, so that the reinforcing plate 8 is temporarily retained at a position which is at a distance from the flexible cable 5 by engaging the tongue piece 8d with the abutment 11a.

With this structure, after the printing head 2 has been set on the carriage 3, the reinforcing plate 8 is first secured at the ground member 8c to the base plate 10 by means of the screw 9 and the reinforcing plate 8 is stood up in the direction of the width thereof so that the tongue piece 8d is engaged with the abutment 11a to retain the reinforcing plate 8 in this position, as shown by the chain line in FIG. 6. Next, the flexible cable 5 is connected to the driver circuit through the connector 6 and, thereafter, the tongue piece 8d of the reinforcing plate 8 is disengaged from the abutment 11a. Then, the ground member 8c is bent so that the reinforcing plate 8 comes into opposed contact with the flexible cable 5 and the hook 71 is engaged with engaging hole 8e. Next, the folded portion of the flexible cable 5 and the corresponding end portion of the reinforcing plate 8 are laid one on top of the other and these two portions are inserted together into the space between the receiver 31 and the retaining piece 32 and, while doing so, the hook 34 is engaged with the engaging hole 8b. Thus, the connection of the flexible cable 5 and the reinforcing plate 8 is completed.

When the printing head 2 is to be replaced with a new one, the engaging hole 8e of the tongue piece 8d is disengaged from the hook 71, and the tongue piece 8d is raised as shown by the arrow and then engaged with abutment 11a (as shown by the chain line in FIG. 6). In this state, the flexible cable 5 is removed from the connector 6. Next, the projection piece 8a is raised to disengage the hook 34 from the engaging hole 8b and, while doing so, the flexible cable 5 and the reinforcing plate 8 are simultaneously removed from the space between the receiver 31 and the retaining piece 32. In this way, the flexible cable 5 can be removed together with the head 2.

After a new printing head has been secured to the carriage 3, the flexible cable 5 and the reinforcing plate 8 are first connected to the connector 6 and then to the carriage 3 in the same procedure as previously described. Thus, the operation of replacing the printing head 2 can be effected with the reinforcing plate 8 kept secured to the base plate 10 of the printer, without the need to remove or replace the reinforcing plate 8.

It should be noted that, although in the foregoing embodiment the reinforcing plate 8 has a three-layer structure in which the shield electrode 81 is sandwiched between plastic sheets 82 and 83, the structure is not necessarily limitative thereto and a two-layer structure wherein a shield electrode is formed on one surface of a plastic sheet may also be employed. Further, the shield electrode 81 only needs to be grounded and, therefore, the shield electrode 81 that is connected to the base plate 10 of the printer is not necessarily exclusive.

The reinforcing plate 8 may be disposed not only on the inner side of the flexible cable 5 when bent but also on both sides thereof.

In the serial printer of the present invention that has the above-described arrangement, the reinforcing plate is in opposed contact with the inner side of the flexible cable when bent to enhance the elasticity of the flexible cable so that the bending motion of the flexible cable is stably performed. Therefore, there is no fear of the flexible cable becoming slack or caught and it is possible to smoothly carry out ultra-high speed printing Since the reinforcing plate contains the shield electrode, it is possible to cut off external electromagnetic waves to thereby eliminate occurrence of a mal-operation of the printer and also prevent generation of electromagnetic noise. Further, since the reinforcing plate is temporarily retained stably at a position which is at a distance from the flexible cable by means of a combination of a tongue piece and an abutment, it is possible to increase the operating efficiency at the time, for example, of assembling or replacement of the printing head. If the reinforcing plate is disposed on each side of the flexible cable, the following advantageous effect is obtained in addition to the above-described advantages, that is, when the head is reciprocated during printing, the flexible cable is bent in a narrow gap between the ribbon cassette and the base plate; however, even in such a case, it is possible to effectively prevent the surface of the flexible cable from becoming worn due to the sliding friction, which would otherwise result in the exposing of the wiring and disconnection to give rise to a connection failure.

What we claim is:

1. In a serial printer, the combination comprising a fixed printer structure means, a carriage having a printing head, said carriage being reciprocably mounted on said structure means, a generally flat flexible cable means extending between said carriage and said structure means, and a generally flat flexible reinforcing plate means comprising a shield electrode disposed in superimposed relationship to said flexible cable means, said shield electrode comprising a film of electrically conductive material, said plate means further comprises flexible insulating material disposed about said film of electrically conductive material.

2. In a serial printer according to claim 1, wherein said cable means is bent over on itself in a generally U-shaped configuration, said plate means being disposed on the inside of the U-shaped configuration.

3. In a serial printer, the combination comprising a fixed printer structure means, a carriage having a printing head, said carriage being reciprocably mounted on said structure means, a generally flat flexible cable means extending between said carriage and said structure means, a separate generally flat flexible reinforcing plate means comprising a shield electrode disposed in superimposed relationship to said flexible cable means, connecting means connecting one end portion of said plate means to said structure means, said connecting means comprising a lateral projection extending laterally from one side of said plate means, fastening means fastening said lateral projection to said structure means, said lateral projection being flexibly joined to said plate means so that said one end portion of said plate means is bendable relative to said lateral projection between a closed position in contact with one side of said cable means and an open position out of contact with said one side of said cable means.

4. In a serial printer according to claim 3, wherein said one end portion of said plate means when in said closed position is disposed to overlie said lateral projection such that said cable means is sandwiched between said lateral projection and said one end portion of said plate means.

5. In a serial printer according to claim 3, wherein said one end portion of said plate means when in said open position is spaced from said cable means to enable disconnection and removal of said cable means from said structure means.

6. In a serial printer according to claim 3, wherein said one end portion of said plate means has a tongue extension which extends laterally from the other side of said plate means, said structure means comprising an abutment disposed on a position such that when said one end portion of said plate means is moved to said open position, said tongue extension engages said abutment to temporarily retain said tongue extension in said open position.

7. In a serial printer according to claim 6, further comprising fastening means for fastening said tongue extension to said structure means when said one end portion of said plate means is in said closed position.

8. In a serial printer according to claim 3, wherein said lateral projection and said one end portion of said plate means are disposed in a generally U-shaped configuration when said one end portion of said plate means is in said closed position.

9. In a serial printer according to claim 3, wherein said one end portion of said plate means has a tongue extension which extends laterally from the other side of said plate means, and fastening means fastening said tongue extension to said structure means when said one end portion of said plate means is in said closed position.

10. In a serial printer according to claim 3, wherein said lateral projection and said structure means comprise means for grounding said lateral projection to said structure means.

11. In a serial printer according to claim 10, wherein said shield electrode comprises a film of electrically conductive material, said plate means further comprising flexible insulation material disposed about said shield electrode, said grounding means comprising an exposed section of said shield electrode from which a portion of said insulation material has been removed.

12. In a serial printer according to claim 3, wherein said structure means comprises a a base plate and a cover plate, said cover plate underlying said one end portion of said plate means, said lateral projection having an underlying portion which underlies said cover plate.

13. In a serial printer according to claim 12, further comprising fastening means fastening said underlying portion to said base plate.

14. In a serial printer, the combination comprising a fixed printer structure means, a carriage having a printing head, said carriage being reciprocably mounted on said structure means, a generally flat flexible cable means extending between said carriage and said structure means, and a separate generally flat flexible reinforcing plate means comprising a shield electrode disposed in superimposed relationship to said flexible cable means, retaining means on said carriage for retaining one end portion of said plate means on said carriage, said retaining means receiving said one end portion of said plate means, said retaining means also receiving a bent over portion of said cable means which has been bent over on itself so as to define two cable leg portions extending about ninety degrees relative to one another with each cable leg portion being joined to one another along a bend line which extends about forty-five degrees relative to the side edges of said cable means.

15. In a serial printer according to claim 14, wherein said retaining means has one extending part which overlies one of said cable leg portions and another extending part which underlies the other of said cable leg portion, said one end portion of said plate means extending between said one and said other extending parts of said retaining means.

16. In a serial printer according to claim 15, wherein said one end portion of said plate means is disposed between said other extending part of said retaining means and said other leg portion of said cable means.

17. In a serial printer according to claim 14, wherein said one end portion of said plate means has a terminating edge, said retaining member having a raised part for positioning said terminating edge in said retaining means.

18. In a serial printer according to claim 17, wherein said raised part is generally parallel to said bend line of said cable means.

19. In a serial printer according to claim 14, wherein said one end portion of said plate means has a lateral extension extending laterally from one side of said plate means, and fastening means on said retaining means engaging said lateral extension to thereby retain said plate means on said retaining means.

20. In a serial printer according to claim 19, wherein said lateral extension has an opening for receiving said fastening means.

21. In a serial printer, the combination comprising a fixed printer structure means, a carriage reciprocably mounted on said structure means, a printer head on said carriage, a generally flat flexible cable means and a generally flat reinforcing plate means disposed in superimposed relationship to said flexible cable means, retaining means on said carriage for retaining said cable means and plate means on said carriage, and connecting means for connecting said plate means to said structure means and for retaining said cable means on said structure means such that said cable means can be removed from said structure means without disconnecting said plate means from said structure means.

22. In a serial printer according to claim 21, wherein said retaining means comprises a detachable fastening means for detachably fastening said plate means to said carriage, said detachable fastening means being detached from said plate means when said cable means is to be removed from said carriage.

23. In a serial printer according to claim 21, wherein said cable means is connected to said printer, said retainer means being operable to release said cable means and said plate means so that said printer with said cable means attached thereto can be removed and replaced with another like printer and attached cable means while said plate means remains connected by said connecting means to said structure means.

24. In a serial printer according to claim 21, wherein said connecting means comprises a first fastening means for fastening said plate means to said structure means, said connecting means further comprising second fastening means for detachably fastening said plate means to said structure means, said second fastening means being detachable from said plate means when said cable means is to be removed from said structure means, said first fastening means remaining fastened to fasten said plate means to said structure means when said cable means is being removed from said structure means.

25. In a serial printer according to claim 1, wherein said shield electrode comprises a single film of electrically conductive material.

* * * * *